US006257323B1

(12) United States Patent
Kuo

(10) Patent No.: US 6,257,323 B1
(45) Date of Patent: Jul. 10, 2001

(54) HEAT DISSIPATING DEVICE

(76) Inventor: Ching-Sung Kuo, No. 38, Lane 111, Nan-Tien-Mu Rd., Tucheng City, Taipei Hsien (TW)

( * ) Notice: Subject to any disclaimer, the term of this patent is extended or adjusted under 35 U.S.C. 154(b) by 0 days.

(21) Appl. No.: 09/592,528

(22) Filed: Jun. 12, 2000

(51) Int. Cl.[7] ..... F28D 15/00

(52) U.S. Cl. ..... 165/104.21; 165/104.33; 165/80.4; 361/699; 361/700; 257/714; 257/715

(58) Field of Search ..... 165/104.33, 104.26, 165/80.4, 104.13, 104.21; 361/698–704; 257/714, 715

(56) References Cited

U.S. PATENT DOCUMENTS

| | | | | |
|---|---|---|---|---|
| 5,203,399 | * | 4/1993 | Koizumi | 165/104.33 |
| 5,269,146 | * | 12/1993 | Kerner | 165/104.33 |
| 5,729,995 | * | 3/1998 | Tajima | 165/104.33 |
| 5,737,923 | * | 4/1998 | Gilley et al. | 165/104.26 |
| 5,998,863 | * | 12/1999 | Kobayashi et al. | 257/715 |
| 6,005,772 | * | 12/1999 | Terao et al. | 361/699 |
| 6,073,683 | * | 6/2000 | Osakabe et al. | 165/104.33 |

* cited by examiner

*Primary Examiner*—Ira S. Lazarus
*Assistant Examiner*—Terrell McKinnon
(74) *Attorney, Agent, or Firm*—Akin, Gump, Strauss, Hauer & feld, L.L.P.

(57) ABSTRACT

A heat dissipating device is used for dissipating heat generated by a heat source, and includes a fluid container made of a heat conductive material, at least one circulating pipe made of a heat conductive material, and a heat dissipating fin unit. The fluid container has a device contacting side adapted to be placed in contact with the heat source, and a pipe connecting side opposite to the device contacting side. The fluid container contains an amount of working fluid therein. The working fluid is capable of changing into fluid vapor when absorbing the heat from the heat source. The fluid vapor is capable of changing into fluid condensate when cooled. The circulating pipe has a vapor input portion, a condensate output portion, and a plurality of interconnected turns between the vapor input and condensate output portions. The vapor input and condensate output portions are mounted on the pipe connecting side of the fluid container so as to permit the fluid vapor to enter into the circulating pipe via the vapor input portion and so as to permit the fluid condensate to flow back into the fluid container via the condensate output portion. The heat dissipating fin unit is mounted on the turns of the circulating pipe.

11 Claims, 3 Drawing Sheets

HEAT DISSIPATING DEVICE

BACKGROUND OF THE INVENTION

1. Field of the Invention

The invention relates to a heat dissipating device, more particularly to a heat-dissipating device having a relatively high heat dissipating efficiency.

2. Description of the Related Art

FIG. 1 illustrates a conventional heat dissipating device 1, which is made of aluminum, having a plurality of heat dissipating fins 10. The conventional heat dissipating device is limited by mold design and requires a minimum thickness of aluminum due to extrusion process constraints. Therefore, the heat dissipating fins 10 are a relatively thick and form a relatively small heat dissipating area, thereby resulting in poor heat dissipating efficiency.

SUMMARY OF THE INVENTION

Therefore, the object of the present invention is to provide a heat dissipating device that can provide a relatively high heat dissipating efficiency.

According to the present invention, a heat dissipating device is used for dissipating heat generated by a heat source, and includes a fluid container, at least one circulating pipe, and a heat dissipating fin unit.

The fluid container is made of a heat conductive material, and has a device contacting side adapted to material, and has a device contacting side adapted to be placed in contact with the heat source, and a pipe connecting side opposite to the device contacting side. The fluid container contains an amount of working fluid therein. The working fluid is capable of changing into fluid vapor when absorbing the heat from the heat source. The fluid vapor is capable of changing into fluid condensate when cooled.

The circulating pipe is made of a heat conductive material, and has a vapor input portion, a condensate output portion, and a plurality of interconnected turns between the vapor input and condensate output portions. The vapor input and condensate output portions are mounted on the pipe connecting side of the fluid container so as to permit the fluid vapor to enter into the circulating pipe via the vapor input portion and so as to permit the fluid condensate to flow back into the fluid container via the condensate output portion.

The heat dissipating fin unit is mounted on the turns of the circulating pipe.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
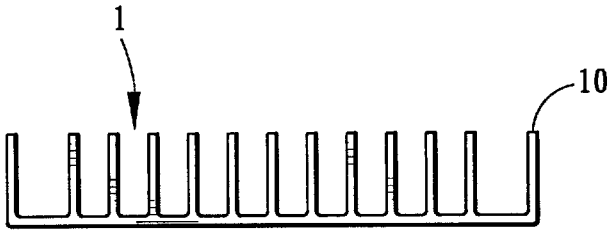
FIG. 1 PRIOR ART
FIG. 1 is a schematic view of a conventional heat dissipating device.

Before the present invention is described in greater detail, it should be noted that like elements are denoted by the same reference numerals throughout the disclosure.

Figure 2:
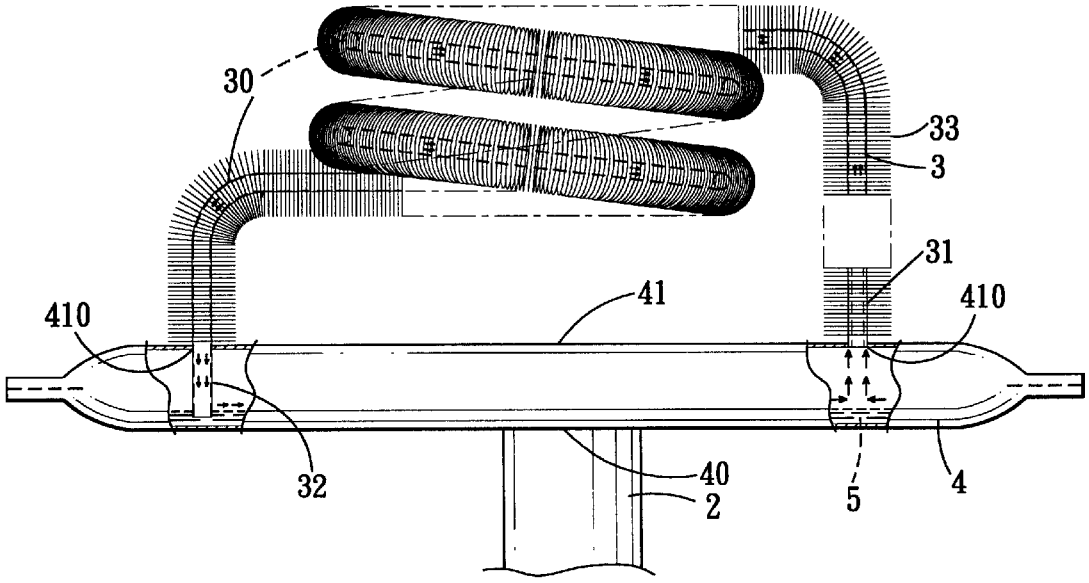
FIG. 2 is a schematic partly cutaway view of the first preferred embodiment of a heat-dissipating device according to this invention.

Referring to FIG. 2, according to the first preferred embodiment of this invention, a heat dissipating device is shown to be adapted for dissipating heat generated by a heat source 2. The heat dissipating device includes a fluid container 4, a circulating pipe 3, and a heat dissipating fin unit.

The fluid container 4, which is made of a heat conductive material, has a device contacting side 40 adapted to be placed in contact with the heat source 2, and a pipe connecting side 41 opposite to the device contacting side 40. The fluid container 4 is substantially flat, and contains an amount of working fluid 5 therein. The working fluid 5 is capable of changing into fluid vapor when absorbing the heat from the heat source. The fluid vapor is capable of changing into fluid condensate when cooled. The pipe connecting side 41 of the fluid container 4 is formed with a pair of mounting holes 410.

The circulating pipe 3, which is made of a heat conductive material, has a vapor input portion 31, a condensate output portion 32, and a plurality of interconnected turns 30 between the vapor input and condensate output portion 31, 32. The vapor input and condensate output portion 31, 32 are mounted on the pipe connecting side 41 of the fluid container 4 via the mounting holes 410 so as to permit the fluid vapor to enter into the circulating pipe 3 via the vapor input portion 31 and so as to permit the fluid condensate to flow back into the fluid container 4 via the condensate output portion 32. The condensate output portion 32 extends deeper into the fluid container 4 than the vapor input portion 31.

The heat dissipating fin unit includes a plurality of fin plates 33 mounted spacedly on the turns 30 of the circulating pipe 3.

Figure 3:
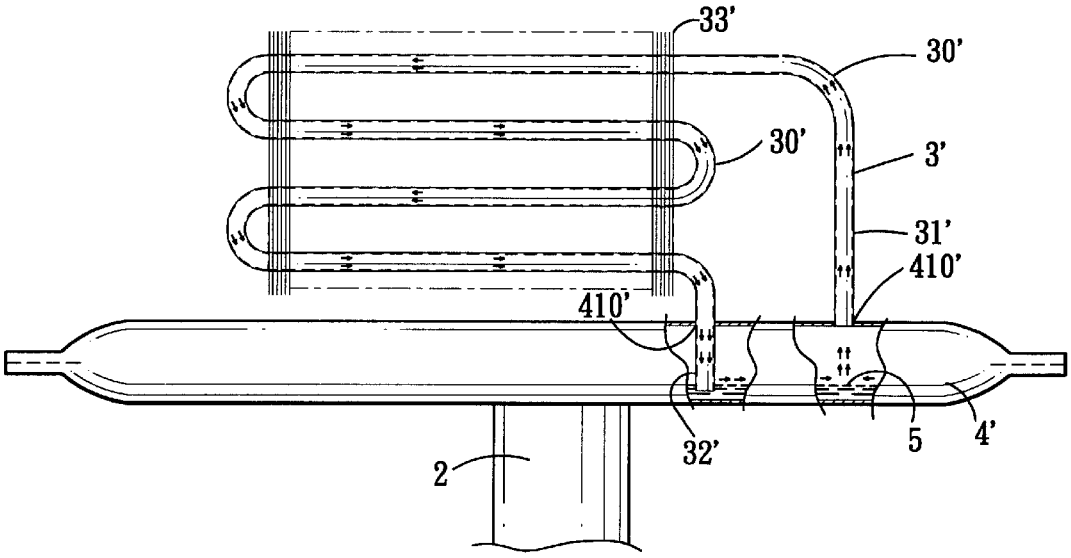
FIG. 3 is a schematic partly cutaway view of the second preferred embodiment of a heat-dissipating device according to this invention.

FIG. 3 illustrates the second preferred embodiment of a heat dissipating device according to this invention, which is a modification of the first preferred embodiment. Unlike the previous embodiment, the circulating pipe 3' has a plurality of turns 30' that are formed to be different from the turns 30 in the first preferred embodiment.

Figure 4:
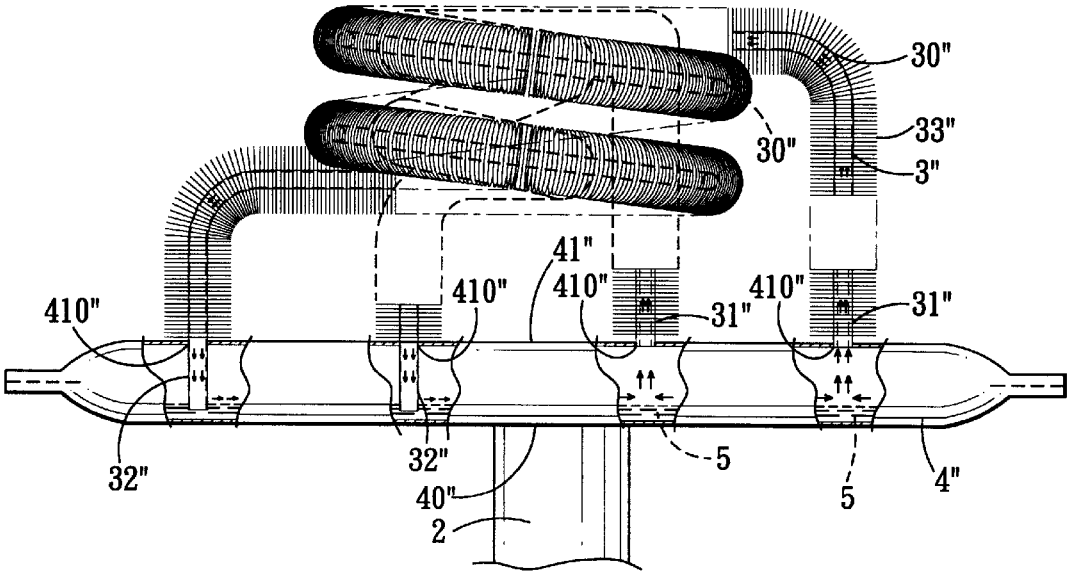
FIG. 4 is a schematic partly cutaway view of the third preferred embodiment of a heat-dissipating device according to this invention.

FIG. 4 illustrates the third preferred embodiment of a heat dissipating device according to this invention, which is a modification of the first preferred embodiment. Unlike the first preferred embodiment, the heat dissipating device includes two circulating pipes 30". The pipe connecting side 41" of the fluid container 4" is formed with two pairs of mounting holes 410" for mounting the vapor input and condensate output portions 31", 32" of the circulating pipes 3" on the fluid container 4". In this embodiment, by adding another circulating pipe 3", the heat dissipating efficiency of the heat dissipating device can be further enhanced.

Figure 5:
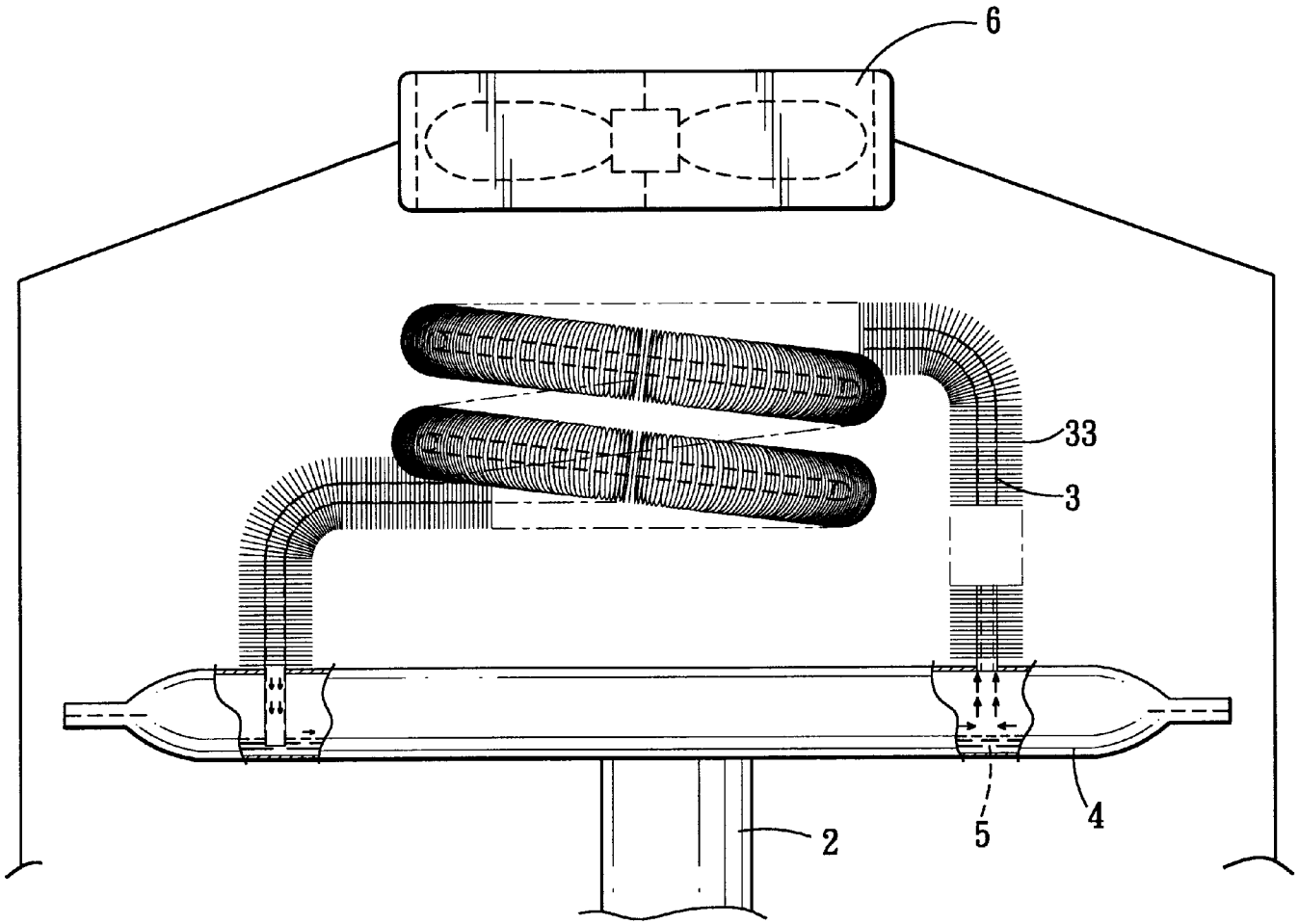
FIG. 5 is a schematic partly cutaway view of the fourth preferred embodiment of a heat-dissipating device according to this invention.

FIG. 5 illustrates the fourth preferred embodiment of a heat dissipating device according to this invention, which is a modification of the first preferred embodiment. Unlike the first preferred embodiment, the heat dissipating device further includes a fan 6 for blowing air toward the circulating pipe 3.

The following are some of the advantages of the present invention:

1. Since the fin plates can provide a relatively large heat dissipating area, the heat dissipating device of this invention can provide a relatively high heat dissipating efficiency.

2. The heat dissipating device of this invention can be designed to have different sizes and shapes, thereby resulting in a flexible design.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A heat dissipating device for dissipating heat generated by a heat source, comprising:

a fluid container made of a heat conductive material and having a device contacting side adapted to be placed in contact with the heat source, and a pipe connecting side opposite to said device contacting side, said fluid container containing an amount of working fluid therein, said working fluid being capable of changing into fluid vapor when absorbing the heat from the heat source, said fluid vapor being capable of changing into fluid condensate when cooled;

at least one circulating pipe made of a heat conductive material and having a vapor input portion, a condensate output portion, and an intermediate portion interconnecting said vapor input and condensate output portions, said intermediate portion being formed with a plurality of interconnected turns that are substantially coaxial about an axis that is generally transverse to said pipe connecting side of said fluid container, said vapor input and condensate output portions being mounted on said pipe connecting side of said fluid container so as to permit said fluid vapor to enter into said circulating pipe via said vapor input portion and so as to permit said fluid condensate to flow back into said fluid container via said condensate output portion; and a heat dissipating fin unit mounted on said circulating pipe.

2. The heat dissipating device of claim 1, wherein said fluid container is substantially flat.

3. The heat dissipating device of claim 1, wherein said condensate output portion extends deeper into said fluid container than said vapor input portion.

4. The heat dissipating device of claim 1, wherein said pipe connecting side of said fluid container is formed with at least one pair of mounting holes for mounting said vapor input and condensate output portions of said circulating pipe on said fluid container.

5. The heat dissipating device of claim 1, wherein said heat dissipating fin unit includes a plurality of fin plates mounted spacedly on said circulating pipe.

6. The heat dissipating device of claim 1, further comprising a fan disposed along the axis for blowing air toward said circulating pipe.

7. A heat dissipating device for dissipating heat generated by a heat source, comprising:

a fluid container made of a heat conductive material and having a device contacting side adapted to be placed in contact with the heat source, and a pipe connecting side opposite to said device contacting side, said fluid container containing an amount of working fluid therein, said working fluid being capable of changing into fluid vapor when absorbing the heat from the heat source, said fluid vapor being capable of changing into fluid condensate when cooled;

at least one circulating pipe made of a heat conductive material and having a vapor input portion, a condensate output portion, and an intermediate portion interconnecting said vapor input and condensate output portions, said intermediate portion having a plurality of generally straight branches that are disposed generally parallel to said pipe connecting side of said fluid container, and a plurality of angled branches, each of which interconnects adjacent ones of said straight branches, one of said straight branches farthest from said pipe connecting side being connected to said vapor input portion, another of said straight branches closest to said pipe connecting side being connected to said condensate output portion, said vapor input and condensate output portions being mounted on said pipe connecting side of said fluid container so as to permit said fluid vapor to enter into said circulating pipe via said vapor input portion and so as to permit said fluid condensate to flow back into said fluid container via said condensate output portion; and a heat dissipating fin unit mounted on said circulating pipe.

8. The heat dissipating device of claim 7, wherein said fluid container is substantially flat.

9. The heat dissipating device of claim 7, wherein said condensate output portion extends deeper into said fluid container than said vapor input portion.

10. The heat dissipating device of claim 7, wherein said pipe connecting side of said fluid container is formed with at least one pair of mounting holes for mounting said vapor input and condensate output portions of said circulating pipe on said fluid container.

11. The heat dissipating device of claim 7, wherein said heat dissipating fin unit includes a plurality of fin plates sleeved spacedly on said straight branches.

* * * * *